United States Patent [19]

MacMaster et al.

[11] Patent Number: 4,742,271

[45] Date of Patent: May 3, 1988

[54] RADIAL-GAIN/AXIAL-GAIN CROSSED-FIELD AMPLIFIER (RADAXTRON)

[75] Inventors: George H. MacMaster, Lexington; Lawrence J. Nichols, Burlington, both of Mass.

[73] Assignee: Raytheon Company, Lexington, Mass.

[21] Appl. No.: 37,088

[22] Filed: Apr. 10, 1987

Related U.S. Application Data

[63] Continuation of Ser. No. 715,803, Mar. 25, 1985, abandoned.

[51] Int. Cl.[4] ..... H01J 25/34

[52] U.S. Cl. ..... 315/39.3; 315/5.35

[58] Field of Search ..... 315/39.3, 5.35

[56] References Cited

U.S. PATENT DOCUMENTS

| | | | |
|---|---|---|---|
| 2,122,538 | 7/1938 | Potter | 315/39.3 X |
| 2,898,507 | 8/1959 | Clarke | 315/39.3 X |
| 3,273,011 | 9/1966 | Brown | 315/39 |
| 3,450,938 | 6/1969 | Farney | 315/39.3 |
| 4,041,349 | 8/1977 | Davis | 315/5.35 X |
| 4,333,038 | 6/1982 | Sato | 315/5.35 X |
| 4,560,904 | 12/1985 | Wolfram | 315/5.35 X |

FOREIGN PATENT DOCUMENTS

| | | | |
|---|---|---|---|
| 944863 | 7/1949 | Fed. Rep. of Germany X | 315/39.3 |
| 1303762 | 8/1962 | France | 315/39.3 |
| 1195805 | 6/1970 | United Kingdom | 315/5.35 |
| 506918 | 5/1976 | U.S.S.R. | 315/5.35 |

*Primary Examiner*—James C. Yeung

*Attorney, Agent, or Firm*—Martin M. Santa; Richard M. Sharkansky

[57] ABSTRACT

A crossed-field amplifier comprises a cylindrical array of anode circuits for broad-band high-power crossed-field operation at millimeter waves. The electric field between the cylindrical anode and the surrounding cylindrical cathode is radial and the magnetic field is axial in the space between the anode and cathode. This space is the interaction region where the power is uniformly distributed over the circumference of each cylindrical array. Power flows radially in and out of the elements of the anode circuit and also axially along the cylindrical $TE_{01}$ guide within the cylindrical anode. The guide is equipped with damping elements for mode control and filter elements for controlling the overall gain, bandwidth, and stability. Because of the radial flow and axial flow of power in the amplifier, it has been termed a Radaxtron.

25 Claims, 3 Drawing Sheets

RADIAL-GAIN/AXIAL-GAIN CROSSED-FIELD AMPLIFIER (RADAXTRON)

This invention was made in the course of a contract with the U.S. Navy, Contract No. N66001-80-C-0278.

This application is a continuation of application Ser. No. 715,803 filed Mar. 25, 1985, now abandoned.

BACKGROUND OF THE INVENTION

This invention relates to crossed-field amplifier tubes for the amplification of extremely high microwave frequencies (EHF) over a broad band. The prior capability of generating power at EHF is limited by a number of factors. Power can be obtained over narrow bandwidths (1–2 GHz) by the use of coupled-cavity tubes (1–2 KW). Helix traveling wave tubes are presently under development to attempt to provide power output in the frequency ranges 18.0–26.5 and 26.5–40.0 GHz range. Other limitations on the type of tubes suitable for generating power in the above frequency ranges are the physical size, weight, and power supply requirements for these tubes. A recognized need in the microwave amplifier field is for amplifier tubes capable of efficient, broadband performance at high power levels at millimeter wavelengths. The problem has been that microwave tubes become smaller at millimeter wavelengths and are thus limited in power. It is therefore an object of this invention to provide a new type of high power microwave amplifier which provides high power amplification over a broad frequency range at EHF frequencies.

SUMMARY OF THE INVENTION

The aforementioned problems are overcome and other objects and advantages are attained by the millimeter wavelength amplifier tube of this invention.

The amplifier of this invention, useful for high power operation at millimeter waves, has a very large number of anode segments to keep power and electron current density within bounds. The amplifier by virtue of its many anode segments enables a growth of cathode diameter by a large factor over conventional tubes. Hence, a tremendous increase of average power capability can be obtained. High average power and high gain are achieved by axially cascading anode structures. The staggered slot anode structure for use at millimeter wave frequencies is particularly suited to the configuration of a cascade of $\pi$-mode rings, coupled together by a circular $TE_{01}$ mode line. The amplifier structure has a cathode surrounding a circular $TE_{01}$ coaxial waveguide core which couples directly to the anode segments in its outer wall. The cathode is a cold secondary emission type and has an emitting surface much larger than that of a conventional tube. Coupling of the $TE_{01}$ drive to the anode segment is inherently tight, making for broad band, moderate power density operation. The anode structure has fabrication and power dissipation advantages. There are size and weight advantages which are gained both for the tube and for the magnet by cascading stages. The increased anode structure and cathode sizes characteristic of the amplifier give this device the promise of useful application up to 90 GHz.

The amplifier is capable of outstandingly high efficiencies. It is also characterized as having relatively low operating voltage, mechanical simplicity, high reliability, and excellent phase stability.

The amplifier is a crossed-field device employing a secondary emission cathode and a reentrant electron beam. The space charge is phase-focussed into spokes by the RF wave in the interaction region. In the preferred embodiment, four interaction slow wave circuits are used in tandem to provide stages of amplification. Each slow wave circuit is coupled to a periodic core filter. Coupling between the periodic core filter and the interaction slow wave circuits is by means of slots at the base of the slow wave circuits. The coupling between the slow wave circuits in the anode and the core filter is tight thereby solving a number of potential problems. The power generation density on the anode circuits is low which solves the problems of dissipation density and emission density limitations of the cathode. The anode slow-wave circuits are coupled to the $TE_{01}$ guide. The tight coupling of the slow-wave anode circuits to the core filter solves the mode control problem by providing single mode propagation in the axial direction. The tight coupling results in the power generation density on the anode circuits being low which reduces problems of dissipation and emission density. The tight coupling promotes enhanced overall bandwidth. The large number of slot circuit elements in each anode slow wave circuit permits gain to be maintained. The core filter section is driven in the $TE_{01}$ mode and energy travels in the axial direction to one of the slow wave circuits and then radially through the slow wave circuit to the interaction region where amplification of the RF power is obtained. The amplified power is radially transmitted back through the slow wave circuit into the core filter region where it preferentially travels axially to the next slow wave circuit of the anode where the RF power is amplified and so on through each succeeding section to the coaxial output of the tube.

The crossed-field amplifier comprises a two-dimensional cylindrical array of anode circuits for high power crossed-field operation at millimeter waves. The electric field between the cylindrical anode and the surrounding cylindrical cathode is radial and the magnetic field is axial in the space between the anode and cathode. Power flow of the amplifier is along the magnetic field direction (perpendicular to the $E \times B$ motion of the electrons). Power flows axially along the cylindrical $TE_{01}$ guide within the cylindrical anode. The guide is equipped with damping elements for mode control and filter elements for controlling the overall gain, bandwidth, and stability. Because of the axial flow and radial flow of power in the amplifier, it has been termed a Radaxtron.

Input signal is fed into one end of a $TE_{01}$ mode coaxial line. The field is produced at slots on the outer conductor of the coaxial line and passes into interaction region where it interacts with the electron cloud provided by a cylindrical cathode. The outer conductor of the coaxial line has rings of longitudinal slots alternating in length. Each length of the slots is resonant with their frequencies of resonance defining roughly the pass band of the amplifier. At frequencies near and between the two resonant frequencies, the slots are very good rf radiators into the interaction region. The $\pi$-mode of rf field is amplified in the interaction region and retransmitted back through the slots where the field is propagated axially down the tube to the next ring of slots. A filter section within the coaxial line of the tube causes the amplified rf to preferentially travel to the next ring of slots rather than back toward the source. Impedance changes within the active tube also produce preferential transmission along the tube to the next amplifying section.

An efficient magnetic design using permanent magnets whose polarity is alternated at successive sections of the anode slow wave structure greatly reduces the leakage flux which would otherwise be significant for such a large anode array and permits an efficient lightweight permanent magnet design. The arrangement for providing the longitudinal magnetic field uses samarium-cobalt magnets at the cathodes with an iron piece between the magnets to provide a flux path. The polarity of the magnets at adjacent cathodes is reversed so that each iron piece has a N-S magnet at its longitudinal ends.

The amplifier uses a secondary emission cold cathode such as a gold-magnesium oxide cathode which provides good starting characteristics with a secondary emission ratio of 2.7 and a low crossover voltage of approximately 20 volts.

The crossed-field amplifier of this invention typically generates 300 kilowatts of peak power at an average power of 3000 watts at a center frequency of 35 GHz with a 16% bandwidth and 12 db gain.

BRIEF DESCRIPTION OF THE DRAWINGS

The aforementioned aspects and other features of the invention are further explained in the following description of a preferred embodiment of the invention taken in conjunction with the accompanying drawings wherein.

DESCRIPTION OF THE PREFERRED EMBODIMENT

Figure 1:
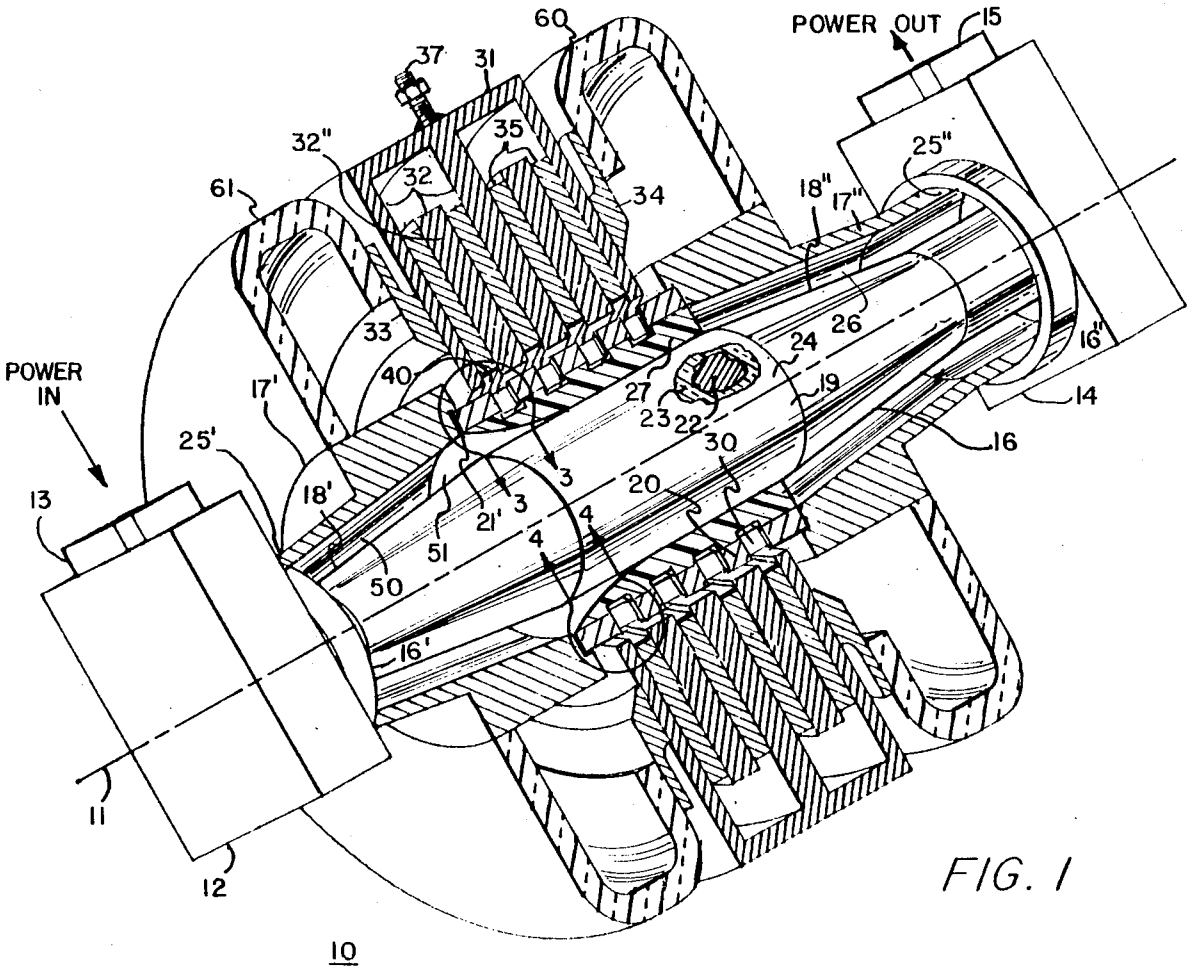
FIG. 1 is an isometric partial cross-sectional view of the crossed-field amplifier tube of this invention.

FIG. 1 shows the tube 10 of the invention in an isometric view in partial cross-section taken along a diagonal section line through the axis of symmetry 11 of the tube. The tube comprises an input microwave transition section 12 which converts the power in to the tube from a $TE_{10}$ mode in waveguide 13 to a $TE_{01}$ mode in the transition section 12. A second transition section 14 at the output end of the tube converts electromagnetic energy at the output of the tube from the $TE_{01}$ mode to the $TE_{10}$ mode for propagation of the power out from the tube in waveguide 15. The center conductor 16 has its end portions 16', 16" forming a portion of the transition sections 12, 14, respectively. The center conductor 16 has its axis coincident with the axis 11 of the tube and is coaxial with its outer conductors 17', 17" which surround the tapered portions 18', 18", respectively of center conductor 16. The central portion 19 of conductor 16 is concentric with the slotted anode 20. Anode 20 has an inner diameter equal to the inner diameter of conductors 17', 17" where they meet at regions 21', 21", respectively, and are electrically connected. Outer conductors 17', 17" and 20 are typically fabricated from copper and are connected at regions 21', 21" by silver solder brazing. The center conductor 16 is comprised of an electrically conductive core material 22, typically copper. The core material 22 is shown in FIG. 1 within the cut-out section 23. The core material 22 is coated with an electrically attenuating layer 24, typically a carbonaceous layer, for attenuation of electric fields at the center conductor 16 and thus the suppression of modes other than the desired $TE_{01}$ mode which has no electric field at the surface of the center conductor 16. The layer 24 is lossy at the microwave frequencies at which the tube operates.

The ends 25', 25" of the outer conductors 17', 17" are brazed to the transition sections 12, 14, respectively. Each of the waveguides 13, 15 contain a window (not shown) which allows microwave energy to pass through the waveguide and also provides a vacuum seal for the tube including the region 26 between the inner conductor 16 and the outer conductor, and the volume 26' encompassed by alumina or beryllia ceramic insulators 35, 36, magnetic structures 31, 33, 34 and conductors 17', 17".

Figure 2:
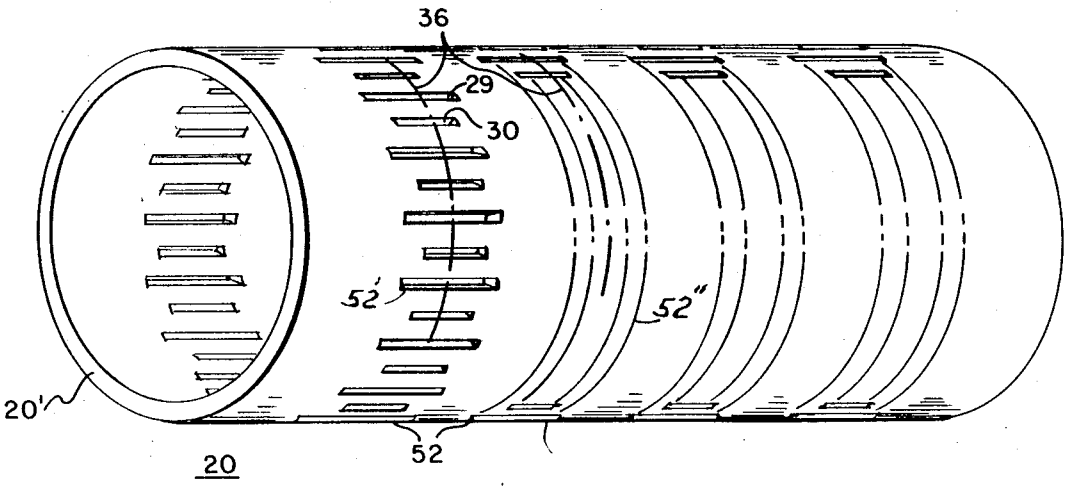
FIG. 2 is an isometric view of the anode of the tube showing rings of slots.

The region 26" between the slotted outer conductor 20 and the central portion 19 of the inner conductor 16 contains the periodic core filter 27 which has circumferential slots 28 which are axially spaced from one another. The material of filter 27 may be alumina or beryllia and completely fill the region 51, or filter 27 may be an electrically conductive metal attached to the center conductor 16 and spaced from the anode 20. The axial spacing of the circumferential slots 28 corresponds to the axial spacing of the rings 52 of slots 29, 30 of the cylindrical outer conductor 20 shown in isometric view in FIG. 2. The short slots 29 alternate with the longer slots 30 with equal spacing between the slots of a ring 52 to form four circumferential rings 52 of equally spaced slots 29, 30. The slots 29, 30 extend in the direction of the axis 11 and penetrate through the radial thickness 20' of the outer conductor 20. The slots 29, 30 are longitudinally symmetric with respect to each circumferential line 36. The spacing between the circumferential lines 36 is equal and coincident with the longitudinal center 28' of the circumferential slots 28 of filter 27. Slots 29, 30 are of equal width in their circumferential dimension.

A magnetic circuit 31 comprises iron disks 32 interleaved with samarium-cobalt disk permanent magnets 35 and iron end pieces 33, 34, each transverse to axis 11. The magnetic circuit 31, magnets 35, disks 32, and the end pieces 33, 34 each have a hole centered on axis 11 and are brazed to form a single unit. The magnetic structure 31 is supported by ceramic insulators 60, 61 which are brazed to the magnetic end pieces 33, 34, respectively and to the outer conductors 17', 17", respectively. The magnetic legs 32 and the magnets 35 have circular holes which are centered on the axis 11 and spaced from the central outer conductor 20. Provision for the application of a negative voltage to the cathodes 41 of tube 10 is provided by the electrical connector 37 which is attached to the electrically conducted magnetic structure 31. The electrical conductivity of the magnetic structure 31 is improved by an electrically conductive coating such as copper or silver on the components of the magnetic structure 31 prior to brazing.

Figure 3:
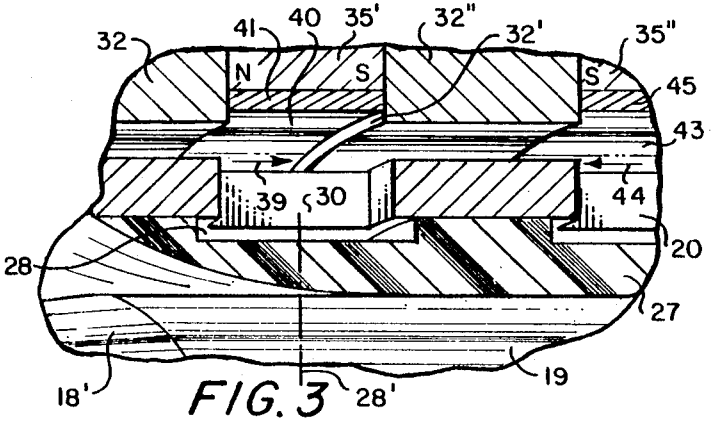
FIGS. 3 and 4 are expanded views of the isometric view of FIG. 1 of the regions defined by boundary lines 3—3 and 4—4, respectively.
Figure 4:
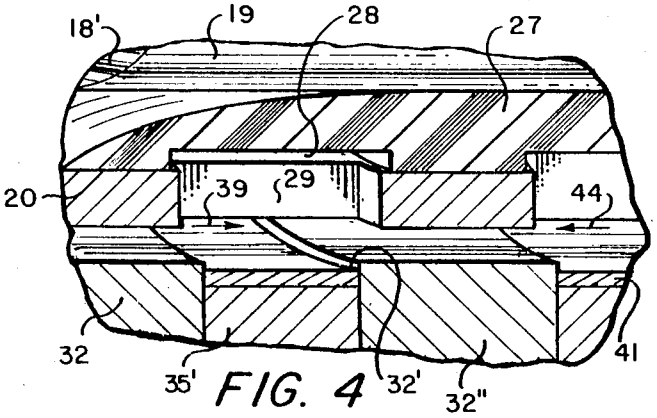
Figure 5:
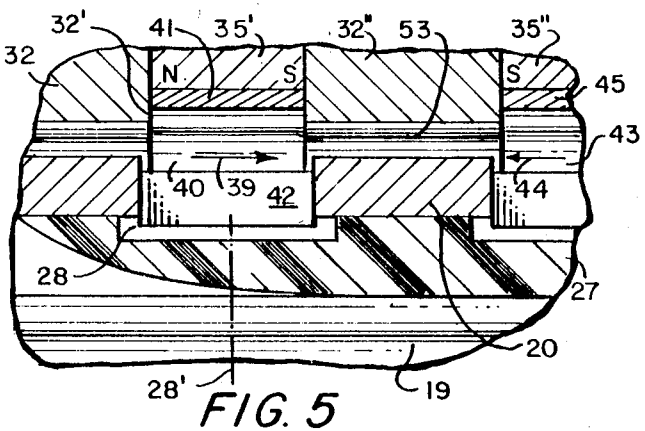
FIGS. 5 and 6 are views transverse to the section shown in FIG. 1 of the regions defined by boundary lines 3—3 and 4—4, respectively.
Figure 6:
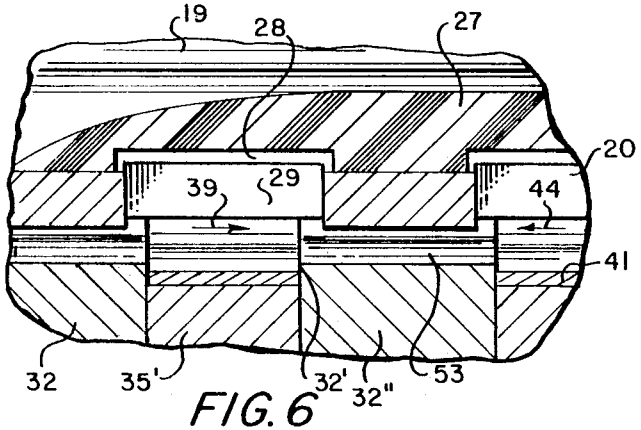

An enlarged view of the iron disks 32, the permanent magnets 35, and the central outer conductor 20 is shown in FIGS. 3 and 4 for the region encompassed by the section lines 3—3 and 4—4 of FIG. 1, respectively. The isometric view in FIG. 3 shows in greater detail than in FIG. 1 the isometric section 3—3 through a shorter slot 29. FIGS. 5 and 6 correspond to FIGS. 3 and 4, respectively, and show the sections 3—3, 4—4, respectively, in transverse cross-section. The magnets 35 are seen to be slightly farther away from the slotted conductor 20 than is the iron disk 32. The cathode 41 is applied to the inner cylindrical surface of magnetic disks 35 leaving a radially extruding portion of disks which acts as cathode end shields 32'. Magnetic disks 35 are magnetized with their N and S poles on opposite faces of each magnetic disk. Adjacent magnetic disk 35 have their north and south poles respectively arranged in opposition as shown in FIGS. 3–6 so that each iron disk 32 has the same polarity magnetic field applied to it by the magnets 35 adjacent both sides of the disk 32. For the case illustrated in FIG. 3, the south poles of magnets 35', 35'' are adjacent iron disk 32''. For the next axially spaced iron disk 32, the north poles of magnets on either side of disk 32 would be adjacent to the iron disk. Magnet 35' of FIG. 3 produces a magnetic field in the direction of direction arrow 39 in the interaction region 40 between the cathode 41 and the anode 42 which comprises the slots 29, 30 and the outer conductor 20. The cathode 41 is preferably a layer of secondary emission material. A suitable material is a thin layer of gold-magnesium oxide which has good starting characteristics with a secondary emission ratio of 2.7 and a low cross-over voltage of approximately 20 volts. Another suitable material is gallium arsenide which has a secondary emission ration of 3.5 and a low cross-over voltage of approximately 20 volts. A thermionic cathode may also be used having the advantage of not requiring a high input power to cause secondary emission but having the disadvantage of requiring a more complicated support structure.

The magnetic field produced by magnet 35'' in the interaction region 43 is in the direction of direction arrow 44. The interaction space 43 exists between the cathode 45 and the slots 29, 30 of anode 42.

Referring now to FIG. 1, the electromagnetic input $TE_{10}$ mode power in waveguide 13 is converted into a $TE_{01}$ mode in the transition section 12. This RF energy propagates down the space 50 between the outer conductor 17' and the inner conductor 18' to the space 51 between the outer conductor 20 and the central portion 19 of inner conductor 16 where the electromagnetic wave impinges upon the tapered filter 27 between these conductors. The electromagnetic energy propagates through the slots 29, 30 of the first row 31 of slots into the first interaction region 40 where the RF energy interacts with the electrons which are emitted by the cathode 41. The interaction of the electromagnetic field and the electrons passing from the cathode 41 to the slotted section of anode 42 in the interaction region 40 causes the electrons to bunch and form a spoke-like configuration.

The RF energy coupled through the slots 29, 30 produces a $\pi$-mode field for the electron interaction. Each single slot is operating near its resonant frequency for frequencies within the pass-band of the amplifier and therefore can be modeled by a tuned parallel LC circuit. Since slots 29, 30 are of different length, the equivalent circuit of two adjacent slots is two LC circuits resonant at different frequencies which are serially connected. The serial LC circuits are considered to be coupled at each end by one-eighth wavelength lines to the short circuit presented by the cathode.

The interaction of the electromagnetic wave in the interaction region 40 with the spoke-like electron beams causes amplification in the interaction region 40 of the electromagnetic energy which passes back through the slots 29, 30 of ring 52' into the propagation region 51 comprising region 26'' and filter 27. The energy which propagates back into the propagation region 51 preferentially passes axially to the next interaction space through the next ring of slots 52'' in the anode 20. The amplified energy which passes back through the slots in ring 52'' also preferentially flows to the right in the axial direction toward the next two interaction regions (not shown in FIG. 3) where this power is amplified in the same manner. The electromagnetic energy which passes through the region 53 between the iron disk 32 and the slotted cylinder 20 from the interaction region 40 to the interaction region 43 is not amplified because the polarity of the magnetic field as seen by direction arrow 44 is opposite to that of the direction of magnetic field 39 in the previous interaction region 40. However, the electromagnetic energy which has been amplified in region 40 and subsequently passes through the slots of ring 52' and through the slots of ring 52'' into the interaction region 43 are of the proper phase to be amplified in the interaction region 43. The process of amplification continues on through the remaining two interaction regions until the energy exiting from the last interaction regions through the slots of row 34 are propagated through the space between the outer electrical conductor 17' and the inner conductor 18'' into the transition section 14 from which the power exits the tube. Preferentially direction of the amplified RF energy axially to the right to successive stages of amplification is provided by the periodic core filter 27 whose slots 28 and tapered section 28'' provide the preferential direction of transmission of energy axially to the right within the region 53 to the coaxial output section 26 within conductors 17'', 18'' of the tube. The output transition section 14 converts the coaxial $TE_{01}$ mode in section 26 to the $TE_{10}$ mode for transmission through output waveguide 15.

In summary, the crossed-field amplifier comprises a two-dimensional cylindrical array of anode circuits for high power crossed-field operation at millimeter waves. The crossed-field amplifier 10 contains two rf slow-wave structures, the slotted anode 20 and the periodic core filter 27. The electric field between the cylindrical anode and the surrounding cylindrical cathode is radial and the magnetic field is axial in the space between the anode and cathode. The slotted rf array 52 of anode 20 is designed to couple to the electron spokes which form between the cathode 41 and the anode 20 under the influence of the RF field in the interaction space 40 and the radial electric field between cathode 41 and anode 20 produced by a negative voltage applied between terminal 37 and the anode 20 and the axial magnetic field. Power flows axially along the cylindrical TE01 guide within the cylindrical anode. The RF slow-wave structure of the core filter 27 slows down the RF wave in the core filter and thereby increases the amount of RF energy which is transmitted through the slotted RF rings 52 of anode 20. The periodic core filter 27 increases the coupling impedance of the millimeter wave slotted circuit rings 52 over a broad band. The dielectric core filter 27 also serves as a large microwave window to transmit high RF power.

The guide is equipped with damping elements for mode control and filter elements for controlling the overall gain, bandwidth, and stability. The copper center conductor 22 has a lossy coating 23 which limits operation to the TE01 mode by inhibiting operation in other modes since the lossy material 23 will cause any longitudinal or circumferential electric field to be attenuated.

The anode slow-wave circuits are coupled directly to the TE01 guide. The tight coupling results in the power generation density on the anode circuits being low which reduces problems of dissipation and emission density. Further, mode control is enhanced. The tight coupling promotes enhanced overall bandwidth. The large number of circuit elements in each anode slow wave circuit permits gain to be maintained. Because of the axial flow of power in the amplifier, it has been termed an axial CFA.

Having described a preferred embodiment of the invention, it will now be apparent to one of skill in the art that other embodiments incorporating its concept may be used. It is felt, therefore, that this invention should not be limited to the disclosed embodiment, but rather should be limited only by the spirit and scope of the appended claims.

What is claimed is:

1. A crossed-field amplifier tube for amplifying a microwave signal comprising:

a coaxial input section for receiving said microwave signal;

a coaxial output section for providing an amplified said microwave signal;

a coaxial waveguide having an inner and an outer cylindrical conductor having a common axis connected at each end to said input and output sections;

the cylindrical outer conductor of said coaxial waveguide being an anode and having at least one ring of axially-extending circumferentially-spaced slots through the wall of said outer conductor to form at least one ring of anode slots;

cylindrical cathode circumferential rings surrounding and axially aligned with each ring of said anode slots respectively and radially spaced therefrom to form a cylindrical interaction region between each cathode ring and the corresponding ring of anode slots in said outer conductor;

a magnetic structure providing a periodically reversing axial field in said interaction region at each said ring of anode slots; and a microwave filter located between the inner and outer conductors of said coaxial waveguide.

2. The amplifier tube of claim 1 wherein said alternate slots of said rings are of different length.

3. The amplifier tube of claim 2 wherein:

the length of the longer of said slots is resonant at a frequency at the lower end of the bandwidth of amplification frequencies of said tube; and the length of the shorter of said slots is resonant at a frequency at the higher end of the bandwidth of amplification frequencies of said tube.

4. The amplifier tube of claim 1 in which said magnetic structure comprises:

a plurality of iron disks;

a plurality of magnetic disks, each having their N and S poles on opposed faces of each disk;

each of said iron and magnetic disks having a hole at the center of each disk, the axis of each of said holes being in alignment with each other and said ring of anode slots;

a cathode material on a cylindrical surface formed by said holes in each in said magnetic disks;

said iron disks and said magnetic disks being alternated with each other to form a cylinder of disks;

the polarity of the magnetic field of each magnetic disk being reversed with respect to a nearest magnetic disk in said cylinder of disks; and the cylinder of disks providing a plurality of opposite polarity axially directed magnetic fields in the region adjacent the surface of the hole of each of said magnetic disks.

5. The amplifier tube of claim 4 wherein:

the diameter of the hole of each of said magnetic disks is larger than the diameter of the hole of each of said iron disks.

6. The amplifier tube of claim 4 wherein said cylindrical cathode comprises:

a secondary emitter material on the surface of the magnetic disks located at the hole of each of said magnetic disks.

7. The amplifier of claim 1 wherein said microwave filter comprises:

a periodic core filter comprising:

a second cylinder substantially filling the space between said outer and inner conductors of said coaxial line;

said second cylinder having a circumferential groove in axial alignment with and adjacent to each of said rings of slots in said outer conductor.

8. The amplifier of claim 7 wherein:

said second cylinder is an electrically conductive metal attached to the inner conductor of said coaxial line and spaced from the outer conductor of said coaxial line.

9. The amplifier of claim 7 wherein:

said second cylinder is a dielectric material.

10. The amplifier of claim 9 wherein:

said dielectric material is selected from the group consisting of alumina and beryllia.

11. The amplifier of claim 7 wherein:

said dielectric material substantially fills the space between said inner and outer conductor.

12. The amplifier of claim 7 wherein:

said second cylinder is tapered in the axial direction at its end facing said coaxial input section.

13. The amplifier tube of claim 1 wherein:

said inner conductor of said coaxial line is coated with a material which is electrically lossy.

14. The amplifier tube of claim 13 wherein:

said coated material covers at least that axial portion of said inner conductor over which amplification occurs in the axially corresponding interaction region.

15. The amplifier of claim 1 comprising in addition:

means for providing a voltage between said cathode and said outer conductor of said coaxial line.

16. The amplifier tube of claim 1 comprising in addition:

a first rectangular waveguide;

a first microwave transition section connected between said first waveguide and said coaxial input section converting the $TE_{10}$ mode in said waveguide to a $TE_{01}$ mode in said coaxial input section;

a second rectangular waveguide;

a second microwave transition section connected between said second waveguide and said coaxial output section converting the $TE_{01}$ mode in said coaxial output section to a $TE_{10}$ mode in said second waveguide;

the cylindrical interaction region between said input and output coaxial sections having the $TE_{01}$ mode.

17. A magnetic structure and cathode for obtaining an axial magnetic field comprising:

a plurality of iron disks;

a plurality of magnetic disks, each having their N and S poles on opposed faces of each magnetic disk;

each of said iron and magnetic disks having a hole at the center of each disk, the axis of said holes being in alignment with each other;

a cylindrical surface provided by said holes in each of said iron and magnetic disks;

a cathode material on said cylindrical surface of said magnetic disks;

said iron disks and said magnetic disks being alternated with each other to form a cylinder of disks;

the polarity of the magnetic field of each magnetic disk being reversed with respect to a nearest magnetic disk in said cylinder of disks; and the cylindrical magnetic disks providing a plurality of opposite polarity axially directed magnetic fields in a region adjacent the cylindrical surface of each of said iron disks.

18. The magnetic structure of claim 17 wherein the diameter of the hole of each of the magnetic disks is larger than the diameter of the holes of the iron disks.

19. The magnetic structure of claim 17 wherein:

at least more than one of said plurality of iron disks are connected together by a iron cylinder at the outer periphery of said iron disks, said iron cylinder being radially spaced from said magnetic disks.

20. A microwave slow-wave circuit comprising:

an electrically conductive first cylinder and a second electrically conductive coaxial cylinder within said first cylinder;

said first cylinder having a cylindrical wall with an inner and outer cylindrical surface having at least one circumferential ring of a plurality of axially directed wall slots through said wall by means of which a portion of electromagnetic energy confined between said first and second cylinders, respectively, passes through said first cylinder wall slots from the inner surface to the outer surface of the wall of said first cylinder; and means for reflecting said portion of electromagnetic energy from the outer surface back to the inner surface of said first cylinder wall through said slots.

21. The circuit of claim 20 wherein:

said first cylinder has a plurality of rings of slots axially spaced from each other along the axis of said first cylinder.

22. The circuit of claim 20 wherein:

said plurality of slots in each ring of slots alternate in length.

23. The circuit of claim 20 wherein:

said first cylinder has a plurality of rings axially spaced from each other along the axis of said first cylinder; and said plurality of slots in each ring alternate in length.

24. The circuit of claim 23 wherein said means for reflecting comprises:

a third electrically conductive cylinder coaxially surrounding and radially spaced from the outer surface of said first cylinder; and comprising in addition:

means for providing a $TE_{01}$-mode of said electromagnetic energy between said first and second cylinder thereby generating a $\pi$-mode of electromagnetic energy between said first and third cylinders in the region between said third cylinder and each said ring of slots in said first cylinder.

25. The circuit of claim 24 comprising in addition:

a periodic core filter between said first and second cylinders; and said filter having annular grooves corresponding in axial position to the axial spacing of said rings.

* * * * *